US010588372B2

(12) United States Patent
Ho

(10) Patent No.: US 10,588,372 B2
(45) Date of Patent: Mar. 17, 2020

(54) MULTILAYERED FLOATABLE UNIVERSAL SHOCK ABSORPTION SYSTEM OF SAFETY HELMET

(71) Applicant: Chang-Hsien Ho, Tainan (TW)

(72) Inventor: Chang-Hsien Ho, Tainan (TW)

( * ) Notice: Subject to any disclaimer, the term of this patent is extended or adjusted under 35 U.S.C. 154(b) by 220 days.

(21) Appl. No.: 15/597,251

(22) Filed: May 17, 2017

(65) Prior Publication Data

US 2018/0255862 A1 Sep. 13, 2018

(30) Foreign Application Priority Data

Mar. 7, 2017 (TW) ..... 106107392 A

(51) Int. Cl.
*A42B 3/06* (2006.01)
*A42B 3/12* (2006.01)
*A63B 71/10* (2006.01)

(52) U.S. Cl.
CPC ..... *A42B 3/064* (2013.01); *A42B 3/063* (2013.01); *A42B 3/12* (2013.01); *A42B 3/121* (2013.01); *A42B 3/122* (2013.01); *A42B 3/124* (2013.01); *A42B 3/125* (2013.01); *A42B 3/127* (2013.01); *A42B 3/128* (2013.01); *A63B 71/10* (2013.01)

(58) Field of Classification Search
CPC ..... A42B 3/064; A42B 3/063; A42B 3/124; A42B 3/125; A42B 3/12; A42B 3/121; A42B 3/122; A42B 3/127; A42B 3/128; A63B 71/10
USPC ..... 2/410, 411, 414, 425, 412
See application file for complete search history.

(56) References Cited

U.S. PATENT DOCUMENTS 3,447,163 A * 6/1969 Tojeiro ..... A42B 3/065 2/412
4,133,055 A * 1/1979 Zebuhr ..... A42B 3/121 2/411
5,349,893 A * 9/1994 Dunn ..... F41H 5/04 2/2.5
6,969,548 B1 * 11/2005 Goldfine ..... B29C 44/1214 428/159
2001/0032351 A1 * 10/2001 Nakayama ..... A42B 3/064 2/412
2004/0117896 A1 * 6/2004 Madey ..... A42B 3/064 2/411

(Continued)

*Primary Examiner* — Khaled Annis
*Assistant Examiner* — Dakota Marin
(74) *Attorney, Agent, or Firm* — Rosenberg, Klein & Lee

(57) ABSTRACT

A multilayered floatable universal shock absorption system of safety helmet includes a main shell body, a subsidiary shell body, an elastic structure body floatably enclosed between the main shell body and the subsidiary shell body and a filling body. The upper and lower sections of the elastic structure body are respectively formed with multiple assembling sections and the main and subsidiary shell bodies are formed with multiple pivotal connection sections floatably correspondingly assembled with the assembling sections. An anchor unit is at least locally positioned between the assembling sections (or the main shell body and subsidiary shell body) in adjacency to each other. The filling body is bonded with the subsidiary shell body to form an integrated form. The structural strength of the entire assembly is enhanced to achieve multiple floatable universal cushioning, rotational torque absorption and external impact force transmission effects.

19 Claims, 13 Drawing Sheets

(56) References Cited

U.S. PATENT DOCUMENTS

| | | | | |
|---|---|---|---|---|
| 2004/0261157 | A1* | 12/2004 | Talluri | A42B 3/063 2/412 |
| 2006/0137073 | A1* | 6/2006 | Crisco | A42B 3/063 2/142 |
| 2007/0000032 | A1* | 1/2007 | Morgan | A42B 3/124 2/412 |
| 2014/0013492 | A1* | 1/2014 | Bottlang | A42B 3/125 2/414 |
| 2014/0223641 | A1* | 8/2014 | Henderson | A42B 3/065 2/411 |
| 2015/0059063 | A1* | 3/2015 | Ho | A42B 3/125 2/411 |
| 2016/0095375 | A1* | 4/2016 | Ho | A42B 3/128 2/411 |
| 2016/0302496 | A1* | 10/2016 | Ferrara | A42B 3/064 |
| 2018/0255861 | A1* | 9/2018 | Ho | A42B 3/063 |

* cited by examiner

MULTILAYERED FLOATABLE UNIVERSAL SHOCK ABSORPTION SYSTEM OF SAFETY HELMET

BACKGROUND OF THE INVENTION

1. Field of the Invention

The present invention relates generally to a multilayered floatable universal shock absorption system of safety helmet, and more particularly to a complex integrated universal cushioning helmet employing a cushion filling body connected with a main shell body, a subsidiary shell body and an elastic structure body to form a multilayered floatable system. The elastic structure body is formed with multiple assembling sections correspondingly assembled with the pivotal connection sections of the main shell body and the subsidiary shell body to form the complex integrated universal cushioning helmet.

2. Description of the Related Art

A conventional safety helmet structure includes a plastic shell body and an anti-impact filling body formed of foam material by heating. The plastic shell body tightly encloses and adheres to the foam filling body to form the safety helmet structure. A user can wear the safety helmet in ball sports or riding exercises to provide protection effect.

In the structural form of such kind of safety helmet, the outer plastic shell serves to resist against the thrust-type impact of an alien object. Also, when bearing the external impact, the foam filling material serves to cushion the impact force and distributively transmit the impact force so as to achieve a protection effect for the user's head.

Another conventional safety helmet further includes a bubble pad attached between the plastic shell and the foam filling body to enhance the cushioning effect. With respect to the structural design and security of such safety helmet, when a general normal external impact force or (thrust force) is applied by a sharp object to the helmet, the bubbles are apt to break. Under such circumstance, the cushioning and impact force absorption effect of the bubble pad will be deteriorated or lost. Moreover, the conventional safety helmet cannot effectively absorb the rotational torque (or shear force) possibly caused by the lateral external impact force so that the injury of the user's head can be hardly minimized.

To speak more specifically, when the user's head hits or is hit by another object, generally two types of mechanical action force will be produced to hurt the user's head, that is, the linear acceleration force and the angular acceleration force. Especially, in bio-dynamics, it is ascertained that the aforesaid rotational torque or angular acceleration force obviously will cause serious destructive brain trauma to a user's head.

In order to improve the problem of trauma of the user's head due to the rotational torque, another type of conventional safety helmet employs filament bodies or dampers disposed between the plastic shell and the lining of the helmet. In this case, when the helmet is hit, the helmet can absorb the aforesaid rotational torque.

As well known by those who are skilled in this field, in order to enhance the structural strength so as to effectively universally absorb the rotational torque, the above filament bodies or dampers must have larger volume (or length) and be (fully) distributed over the entire helmet by high density (or amount). This will increase the total volume and weight of the safety helmet to obviously affect the comfortableness and time of wear. Also, this fails to meet the requirements of lightweight and thinned design of the structure and simplified manufacturing process. This is not what we expect.

That is, on one hand, the safety helmet must have sufficient structural strength to resist against (or bear) the external normal impact force and must be able to universally absorb the rotational torque, and on the other hand, the volume and weight of the safety helmet must be as minimized as possible. This is a situation of dilemma.

To speak representatively, the conventional safety helmet has some shortcomings in design of the structure and the manufacturing process. Also, in practice, some problems existing in the assembling structures of the outer shell body (or plastic shell) and the inner structure body of the conventional safety helmet. To overcome the above shortcomings, it is necessary to redesign the assembling structures and connection relationship between the shell body and the lining structure (or foam material layer) of the conventional safety helmet so as to enhance the structural strength and change the safety helmet into a different one. The redesigned safety helmet has more ideal protection and cushioning ability and is able to universally absorb the rotational torque. Accordingly, the distribution and transmission pattern of the external impact force are changed to improve the shortcomings of the conventional safety helmet.

It is found that the conventional safety helmet structure has some shortcomings, (for example, the bubble pad is apt to break to lose the cushioning and shock absorption effect). In this case, the inner structure body (or the foam material layer) of the safety helmet structure cannot effectively distribute and transmit various external impact forces (normal or lateral) to the respective parts of the entire helmet body. As a result, the respective parts of the structure cannot universally bear the various impact forces. This needs to be improved. In addition, the conventional safety helmet employs filament bodies or dampers. This leads to increase of the total volume and weight of the helmet and the structural strength (rigidity) of the helmet is insufficient. This also needs to be improved. Especially, the assembling structures of the safety helmet must be changed to have higher structural strength in all directions or parts than the conventional safety helmet so as to enhance the ability to bear and support the external impact or lateral impact force. Moreover, the safety helmet must meet the trend to simplify manufacturing process and design lightweight and thin safety helmet structure. All these issues are not suggested or disclosed in the above reference patents so that the conventional safety helmets fail to meet the requirements of the safety helmet at the current stage.

SUMMARY OF THE INVENTION

It is therefore a primary object of the present invention to provide a multilayered floatable universal shock absorption system of safety helmet includes a main shell body, a subsidiary shell body, an elastic structure body floatably enclosed between the main shell body and the subsidiary shell body and a filling body. The upper and lower sections of the elastic structure body are respectively formed with multiple assembling sections and the main and subsidiary shell bodies are formed with multiple pivotal connection sections floatably correspondingly assembled with the assembling sections. An anchor unit is at least locally positioned between the assembling sections (or the main shell body and subsidiary shell body) in adjacency to each other. The filling body is bonded with the subsidiary shell body to form an integrated form. The structural strength of the entire assembly is enhanced to achieve multiple floatable universal cushioning, rotational torque absorption and external impact force transmission effects.

The term "floatable" means when an external action force is applied to the safety helmet, the parts of the safety helmet will respond to the external action force to relatively move and/or rotate within the helmet. For example, when the elastic structure body responds to the external action force, the elastic structure body can be elastically squeezed and deformed to relatively move and/or rotate between the main shell body and the subsidiary shell body.

In the above multilayered floatable universal shock absorption system of safety helmet, the pivotal connection sections of the main shell body and the subsidiary shell body have protruding walls. The protruding walls define the pivotal connection sections to have a geometrical configuration (such as hexagonal configuration). Accordingly, the pivotal connection sections are adjacent to each other to form a cellular structure. The assembling sections of the elastic structure body are formed with grooves. The grooves define the assembling sections to have a geometrical configuration (such as hexagonal configuration). Accordingly, the assembling sections are adjacent to each other to form a cellular structure. The assembling sections are correspondingly assembled with the pivotal connection sections.

In the above multilayered floatable universal shock absorption system of safety helmet, an anchor unit is positioned between the main shell body and the subsidiary shell body. In practice, the anchor unit can be disposed on the elastic structure body. For example, the anchor unit is arranged on an assembling section or locally between two assembling sections in adjacency to each other. The anchor unit is an I-shaped structure. The anchor unit includes a base section and a first arm and a second arm formed on the base section. Each of two ends of the first and second arms of the anchor unit is formed with a finger section. The finger sections are correspondingly assembled with the assembling sections of the upper and lower sections of the elastic structure body. This establishes a system or an effect to support the elastic structure body.

Therefore, when the elastic structure body and/or the anchor unit responds to (or bears) an external impact force or rotational torque. The anchor unit and the elastic structure body are elastically deformed to together cushion and absorb the action force. Moreover, after the external impact force or the rotational torque disappears, the anchor unit further helps the elastic structure body to restore to its home position.

The present invention can be best understood through the following description and accompanying drawings, wherein:

DETAILED DESCRIPTION OF THE PREFERRED EMBODIMENTS

Figure 1:
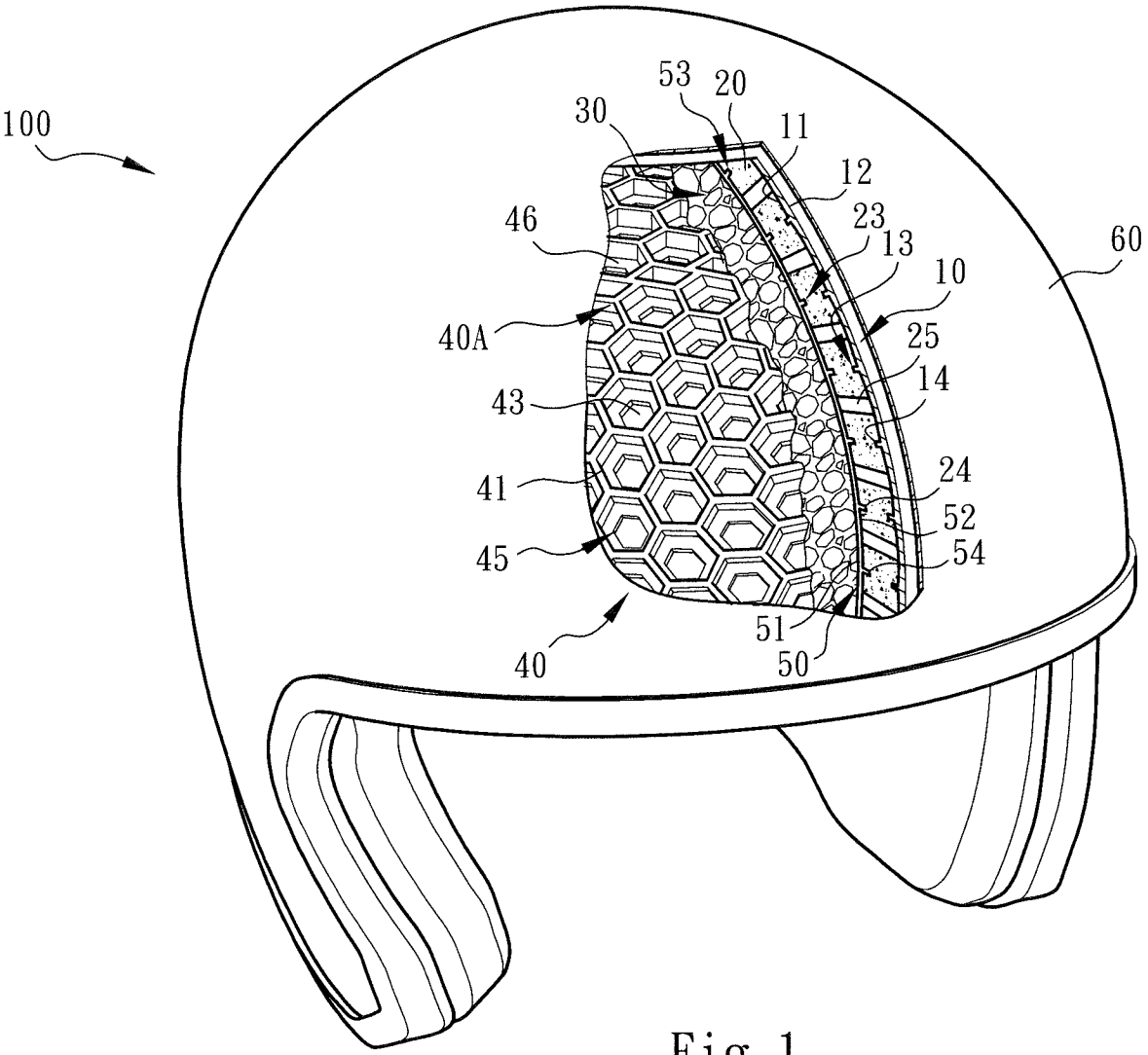
FIG. 1 is a perspective sectional view of the present invention, showing that the main shell body, the elastic structure body, the subsidiary shell body, the filling body and the subsidiary structure body are assembled with each other.
Figure 2:
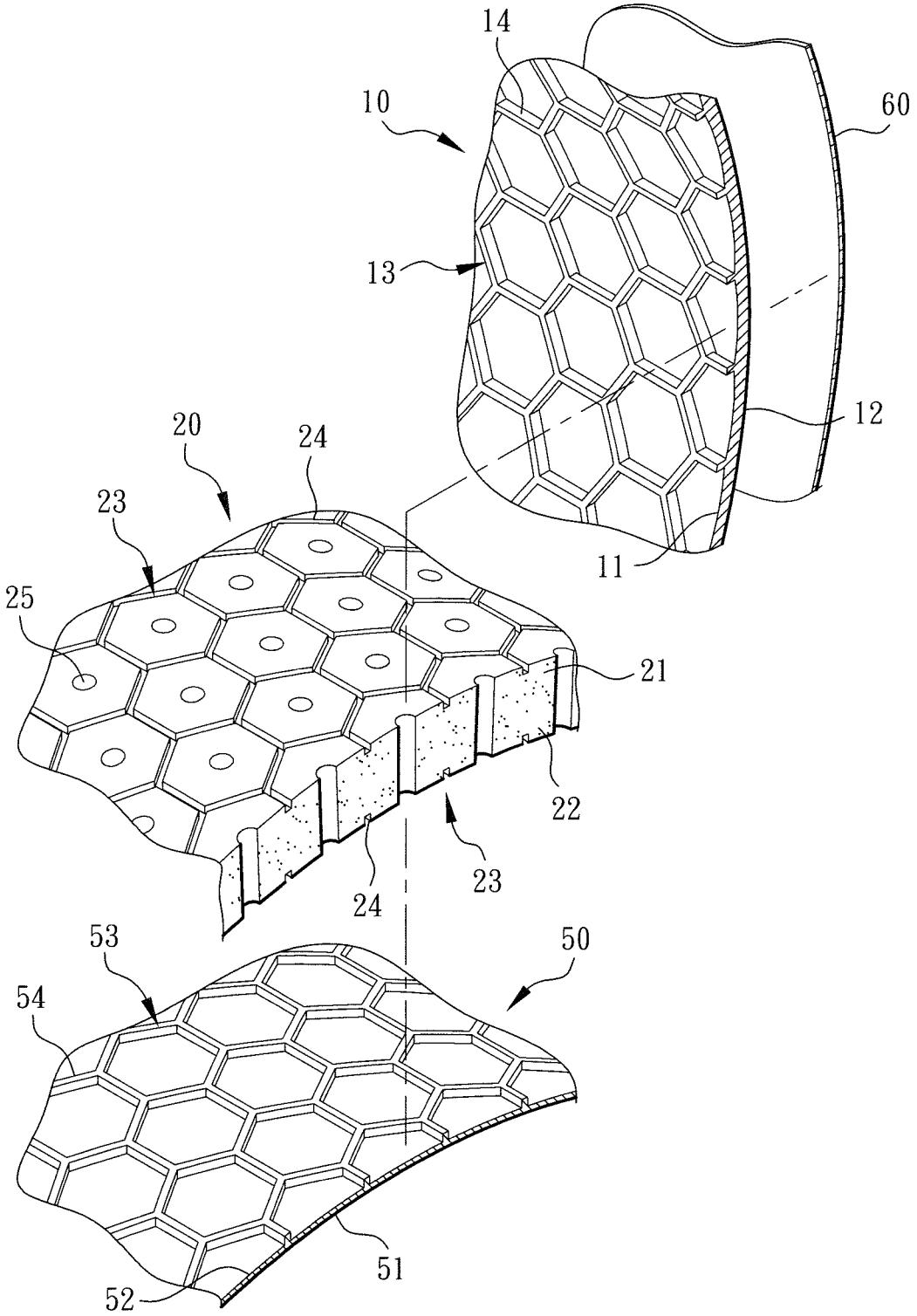
FIG. 2 is a perspective view showing the main shell body, the elastic structure body and the subsidiary shell body of the present invention.
Figure 3:
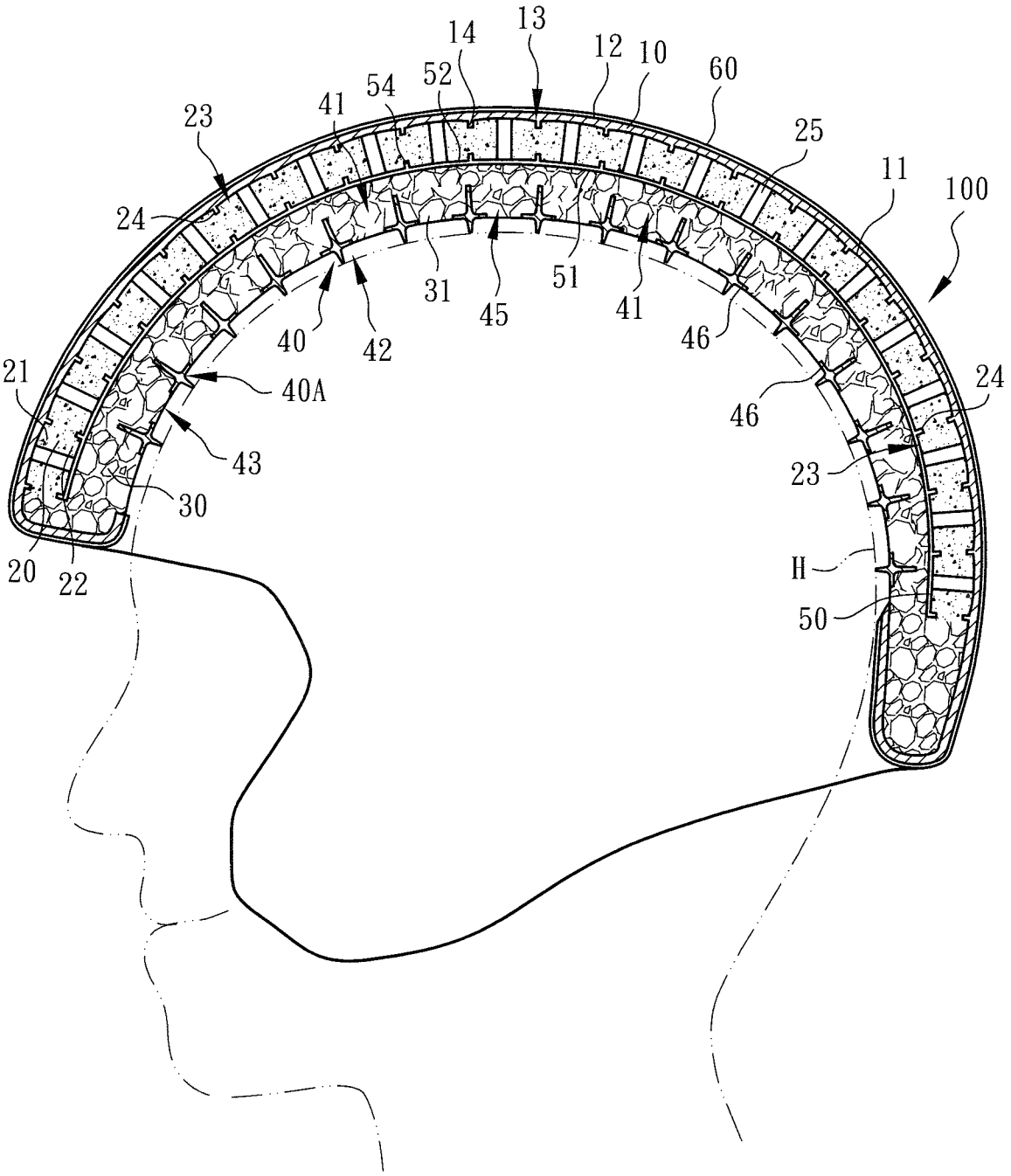
FIG. 3 is a plane sectional view of the present invention, showing that the main shell body, the elastic structure body, the subsidiary shell body, the filling body and the subsidiary structure body are assembled with each other.

Please refer to FIGS. 1, 2 and 3. The multilayered floatable universal shock absorption system of safety helmet of the present invention is selectively exemplified with a safety helmet for sport wear. The safety helmet can be a football helmet, a hockey helmet, an engineering helmet, a mountaineering helmet, an equestrianism helmet, a bicycle helmet, a motorcycle helmet, a skiing helmet, a car racing helmet, etc. in a full face form or an open face form. The safety helmet includes a main shell body 10, at least one elastic structure body 20, a subsidiary shell body 50 and a filling body 30 formed of cushion foam material.

The upper section, upper side, lower section, lower side or bottom section mentioned hereinafter are referred to with the direction of the drawings as the reference direction. In addition, the part directed to the helmet wearer is defined as inner face or inner side, while the part directed away from the helmet wearer is defined as outer face or outer side.

In a preferred embodiment, the main shell body 10 and the subsidiary shell body 50 can be selectively made of plastic material. Each of the main shell body 10 and the subsidiary shell body 50 has an inner face 11, 51 directed to the helmet wearer and an outer face 12, 52 directed away from the helmet wearer. The inner face 11 of the main shell body 10 and the outer face 52 of the subsidiary shell body 50 respective contact or connect with the elastic structure body 20. In addition, a protection layer 60 is disposed on the outer face 12 of the main shell body 10. The protection layer 60 is selectively made of fiber glass, fiber carbon or the like material. The protection layer 60 serves to enhance the structural strength of the main shell body 10.

As shown in the drawings, the inner face 11 of the main shell body 10 and the outer face 52 of the subsidiary shell body 50 are respectively formed with (elastic) pivotal connection sections 13, 53. The pivotal connection sections 13, 53 of the main shell body 10 and the subsidiary shell body 50 respectively have protruding walls 14, 54. The walls 14, 54 define the pivotal connection sections 13 (or 53) to have a cross section with a geometrical configuration (such as hexagonal configuration). Accordingly, the pivotal connection sections 13 (or 53) are adjacent to each other to form a cellular structure.

In this embodiment, one or multiple elastic structure bodies 20 are disposed between the main shell body 10 and the subsidiary shell body 50. The elastic structure body 20 is selectively made of flexible or elastic material such as EPS, EVA, rubber or the like material. Therefore, the elasticity ratio (or deformation amount) of the elastic structure body 20 is larger than the elasticity ratio (or deformation amount) of the filling body 30. Accordingly, the deformation and cushion shock absorption effect of the elastic structure body 20 is enhanced.

As shown in the drawings, the elastic structure body 20 is defined with or has an upper section 21 and a lower section 22. The upper section 21 contacts or connects with the inner face 11 of the main shell body 10. The lower section 22 contacts or connects with the outer face 52 of the subsidiary shell body 50. The upper and lower sections 21, 22 of the elastic structure body 20 are respectively formed with multiple assembling sections 23. The assembling sections 23 of the elastic structure body 20 are formed with grooves 24. The grooves 24 define the assembling sections 23 (to have a cross section) with a geometrical configuration (such as hexagonal configuration). Accordingly, the assembling sections 23 are adjacent to each other to forma cellular structure. The assembling sections 23 are correspondingly assembled with or mortised with the pivotal connection sections 13, 53.

In a preferred embodiment, the elastic structure body 20 has holes 25 formed on the assembling sections 23 and passing through the elastic structure body 20. A fluid can be filled in the holes 25 to adjust or change the elasticity ratio of the elastic structure body 20.

Figure 4:
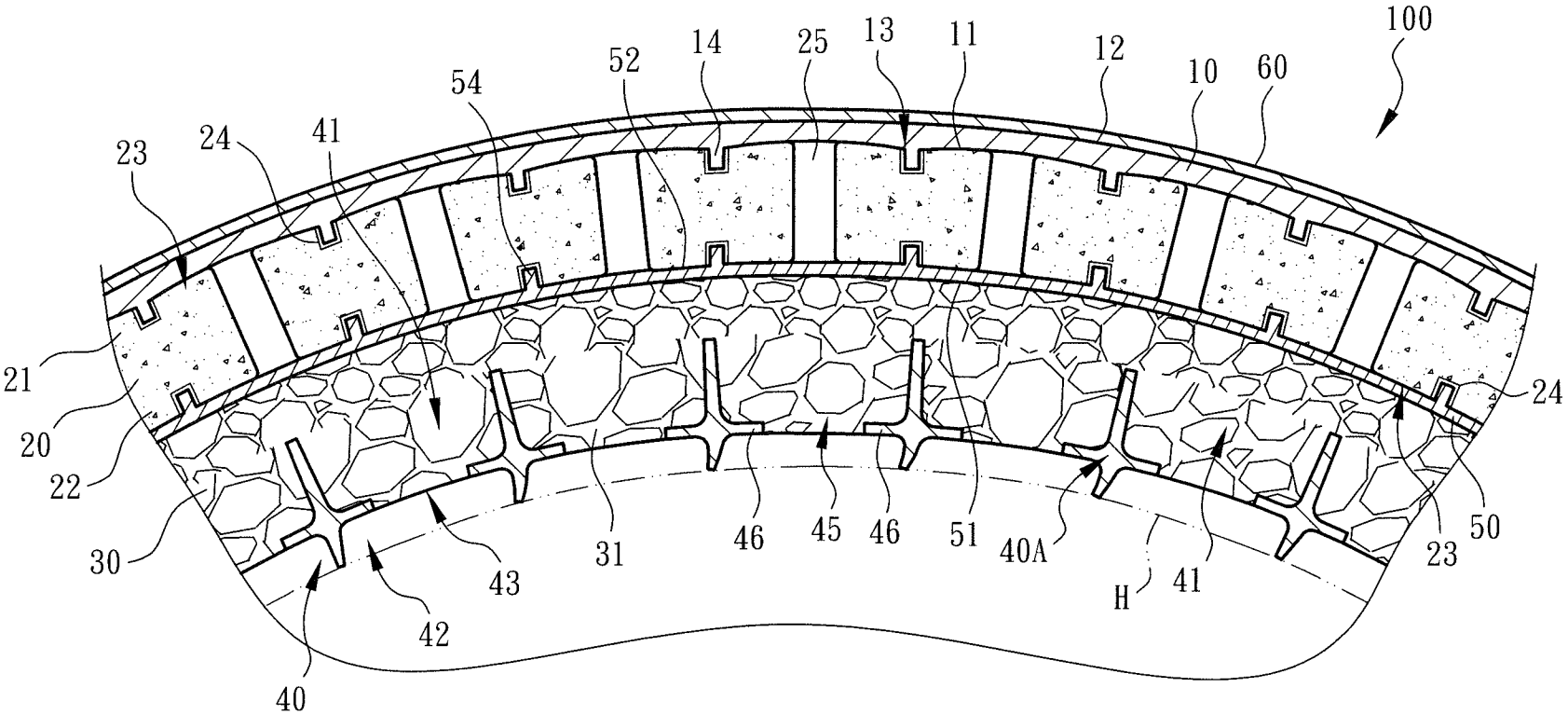
FIG. 4 is an enlarged view of a part of FIG. 3.

Please now refer to FIGS. 3 and 4. A filling body 30 is disposed and assembled on the inner face 51 of the subsidiary shell body 50. In this embodiment, by means of a mold or a molding module, the filling body 30 is bonded with the subsidiary shell body 50, whereby the main shell body 10 encloses the elastic structure body 20, the subsidiary shell body 50 and the filling body 30 to form an integrated complex structure (or termed assembly 100) as the multi-layered floatable universal shock absorption system.

The term "floatable" means when an external action force is applied to the safety helmet, the parts of the safety helmet will respond to the external action force to relatively move and/or rotate within the assembly 100. For example, when the elastic structure body 20 responds to the external action force, the elastic structure body 20 can be elastically squeezed and deformed to relatively move and/or rotate between the main shell body 10 and the subsidiary shell body 50.

Figure 5:
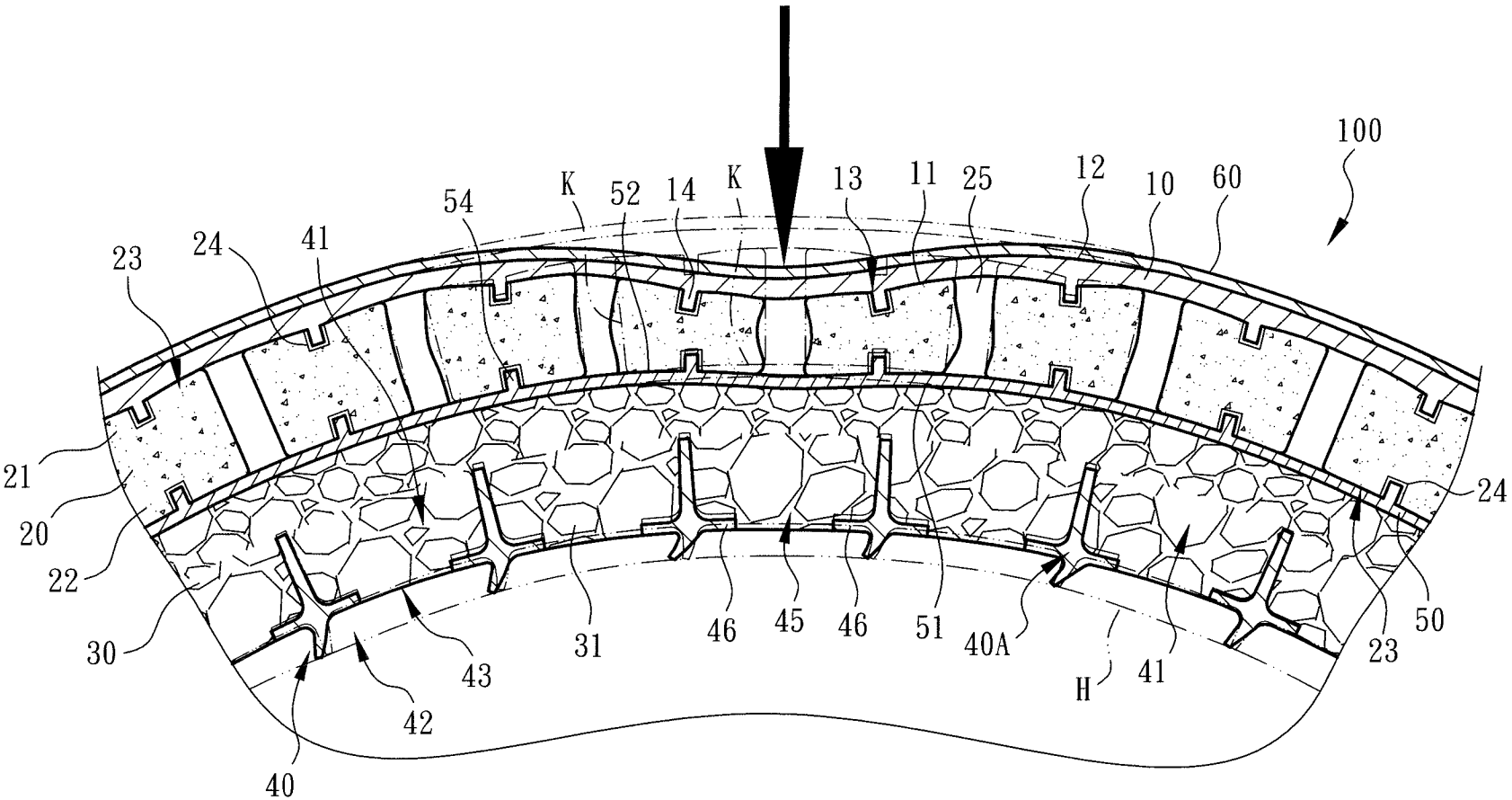
FIG. 5 is a view according to FIG. 4, showing that an external impact force (or normal force) is applied to the assembly.
Figure 5A:
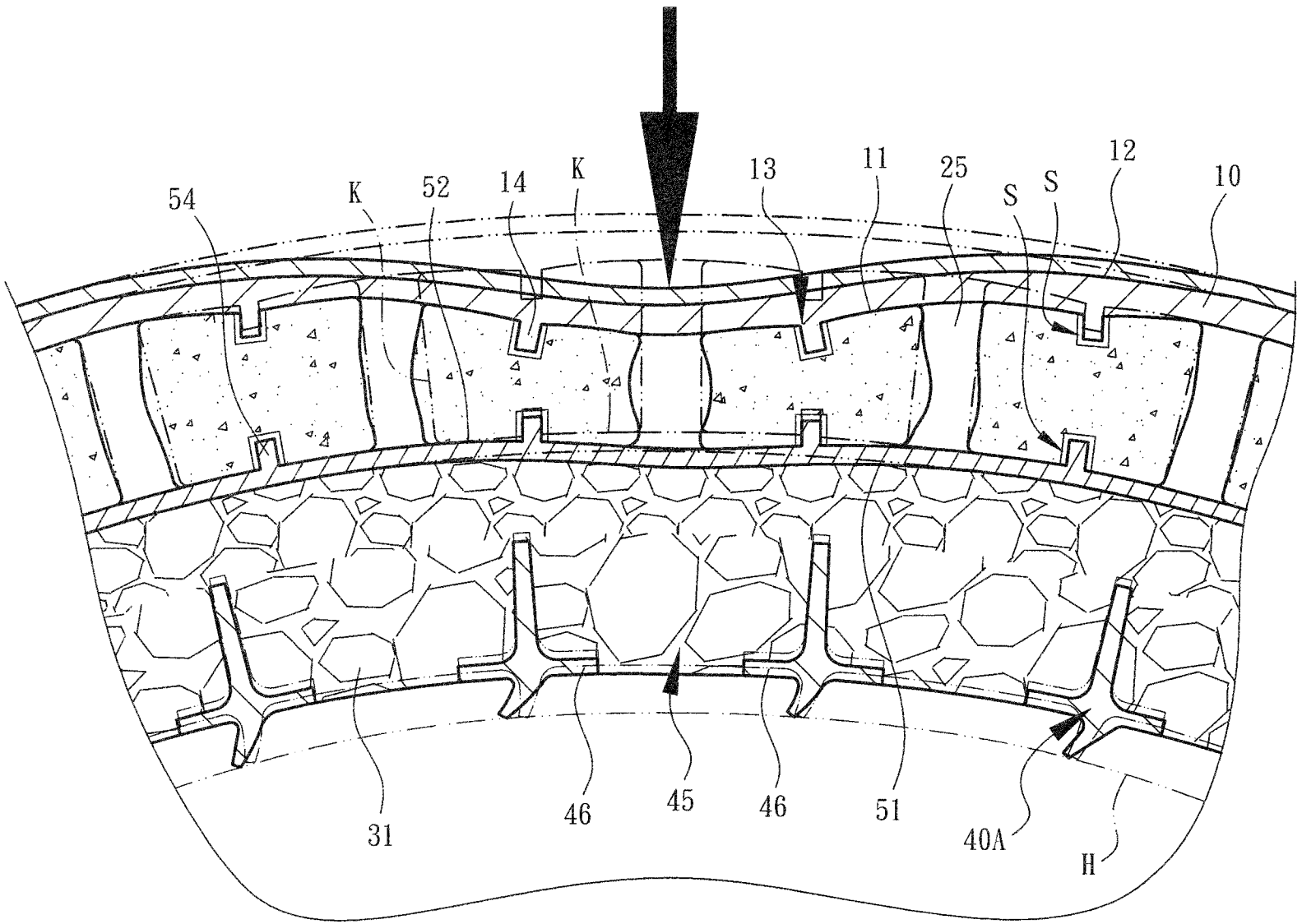
FIG. 5A is an enlarged view of a part of FIG. 5.
Figure 6:
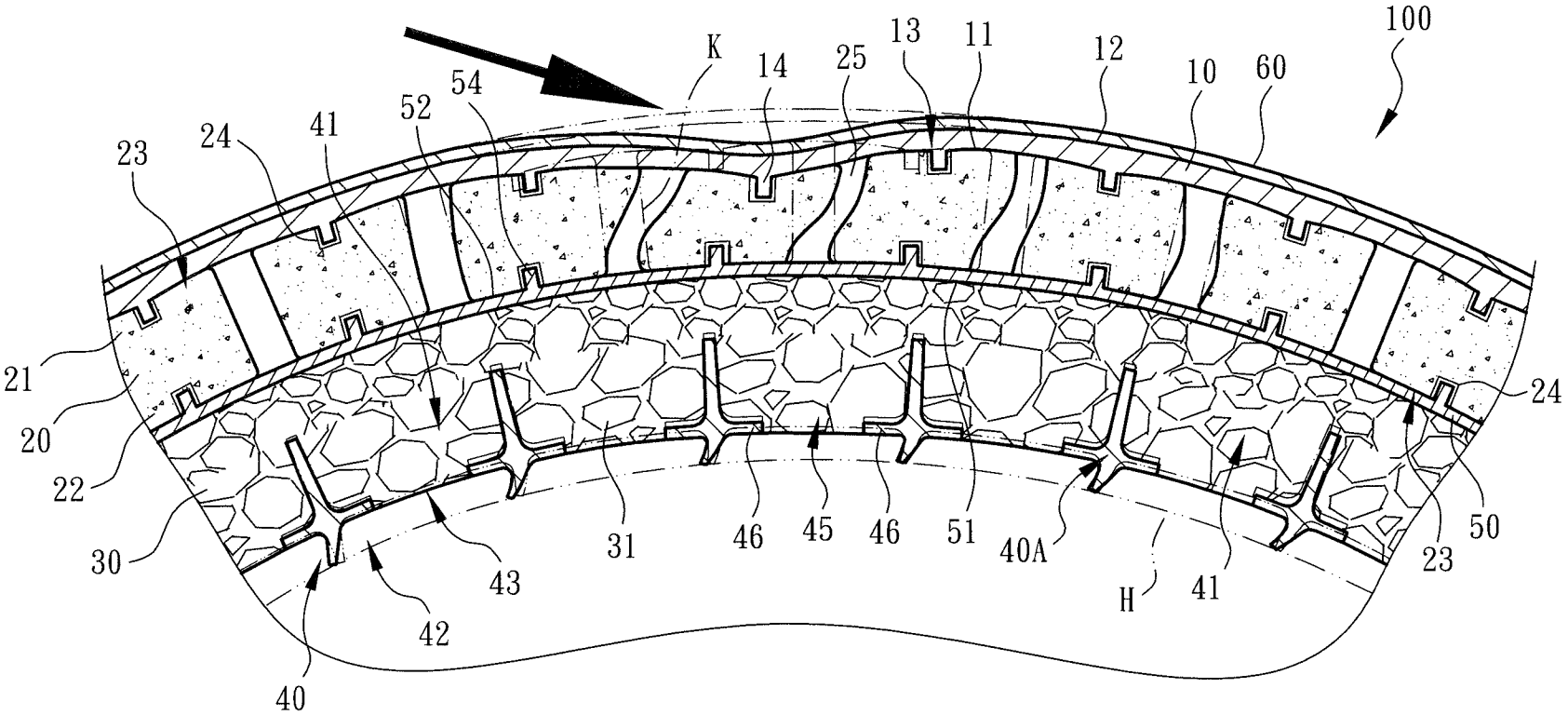
FIG. 6 is a view according to FIG. 4, showing that an oblique external impact force (or shear force) is applied to the assembly.
Figure 6A:
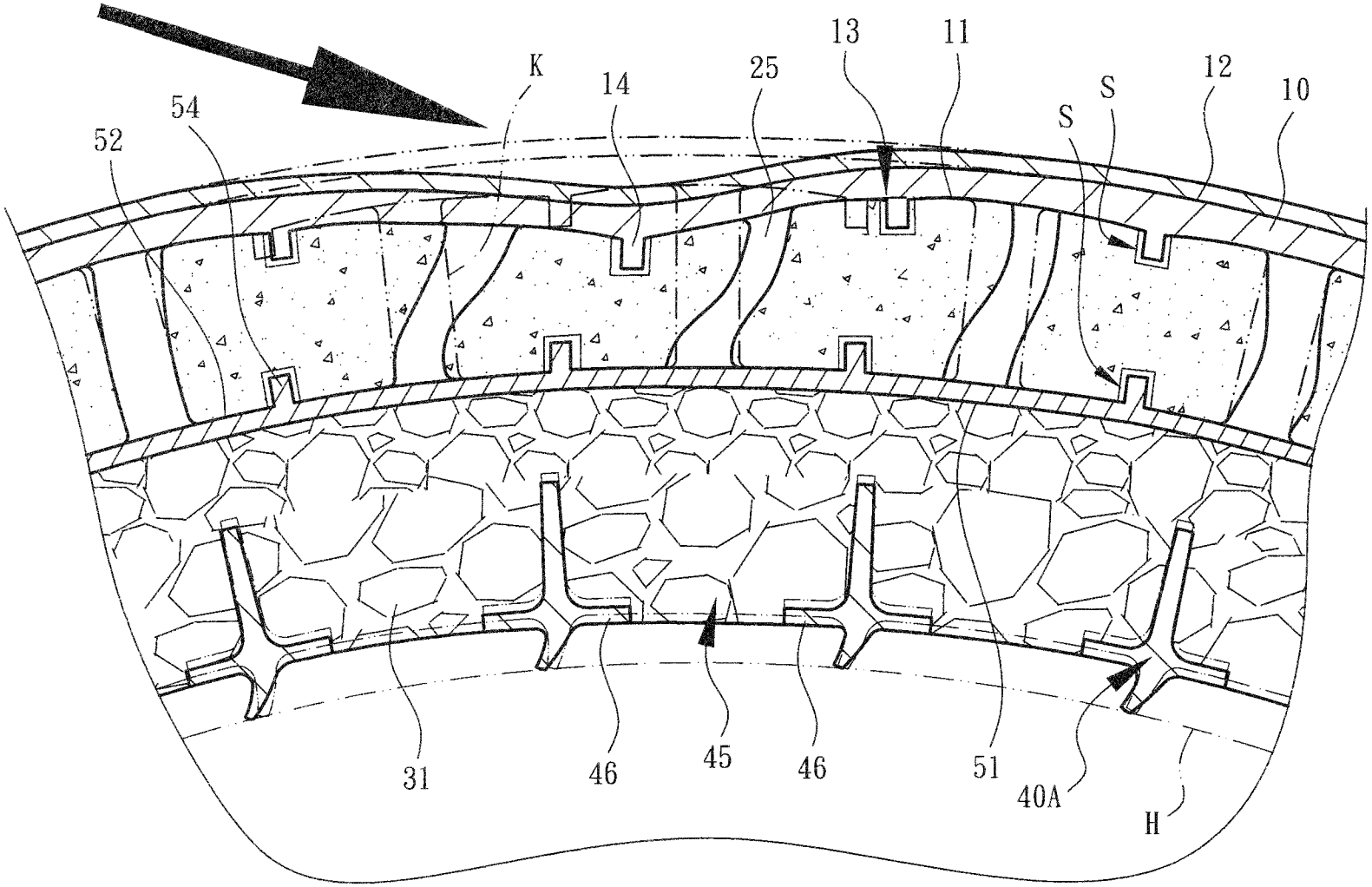
FIG. 6A is an enlarged view of a part of FIG. 6.

It should be noted that in the case that gaps S (as shown in FIGS. 5A and 6A) exist between the elastic structure body 20 (or the assembling sections 23), the main shell body 10 (or the pivotal connection sections 13), and the subsidiary shell body 50 (or the pivotal connection sections 53), the range of the aforesaid "floatability" can be increased.

FIGS. 3 and 4 (or FIG. 1) also disclose that a lining or a subsidiary structure body 40 is connected and assembled with the lower section 31 of the innermost layer or foam filling body 30 of the assembly 100. The lining or subsidiary structure body 40 serves to contact and enclose the head H of a user (as shown by the phantom line of the drawing).

In a preferred embodiment, the subsidiary structure body 40 is selectively made of flexible or elastic material (such as rubber or the like material). The subsidiary structure body 40 has the form of a cellular texture. The (foam) material of the filling body 30 is partially connected or bonded with the subsidiary structure body 40 to form an integrated structure.

The drawings (or FIG. 1) show that the subsidiary structure body includes multiple skeletons 40A. The skeletons 40A define multiple well-shaped structure sections 45, (which have a cross section) with a geometrical configuration (such as hexagonal configuration). In addition, each skeleton 40A has wing sections 46 protruding toward the center of the well-shaped structure section 45 (or the periphery of the well-shaped structure section 45). Accordingly, the well-shaped structure section 45 is defined with a first section 41, a second section 42 and a subsidiary section 43 between the first and second sections 41, 42.

Therefore, the material of the filling body 30 is partially filled up into the first section 41 and the subsidiary section 43 to connect with the wing sections 46.

To speak more specifically, the material of the filling body 30 partially goes into every first section 41 and/or every subsidiary section 43, whereby the filling body 30 is connected or bonded with the subsidiary structure body 40 to form an integrated structure. In addition, the foam filling body 30 provides a system or effect for supporting the subsidiary structure body 40. The term "bonded" means that the material of the filling body 30 is passed through or filled in and connected with the subsidiary structure body 40 (or the first section 41 and the subsidiary section 43).

The drawings show that the material of the filling body 30 partially goes into the first sections 41 and/or the subsidiary section 43. Therefore, the density of the filling body 30 in the subsidiary structure body 40 (the first section 41 and/or the subsidiary section 43) is smaller than the density of the filling body 30 outside the subsidiary structure body 40. The different densities of the foam structure provide different action force (or impact force) transmission, distribution, cushioning and absorption effects.

In a preferred embodiment, the hardness of the main shell body 10 (or the subsidiary shell body 50) is larger than the hardness of the filling body 30 and the hardness of the filling body 30 is larger than the hardness of the elastic structure body 20. Also, the hardness of the elastic structure body 20 is larger than the hardness of the subsidiary structure body 40.

Please now refer to FIGS. 5 and 5A. When an external impact force (or normal force) is applied to the assembly 100, the main shell body 10 and/or the subsidiary shell body 50, the filling body 30 and the elastic structure body 20 are cooperatively elastically deformed by a larger amount so as to decrease the speed of the external impact force and together bear the external impact force to provide a cushioning and shock absorption effect. Accordingly, the external impact force is universally (or multidirectionally) distributively transmitted to the filling body 30 and/or the entire assembly 100. After the external impact force disappears, due to the structural property of the elastic structure body 20 and/or the filling body 30 (or the subsidiary shell body 50), the components of the assembly 100 are as restored to their home positions as possible (as shown in FIG. 4). For example, the components of the assembly 100 are restored to their home positions as shown by the phantom lines K of FIGS. 5 and 5A.

Please now refer to FIGS. 6 and 6A. When an external impact force (or shear force) is applied to the assembly 100, the main shell body 10 and/or the subsidiary shell body 50, the filling body 30 and the elastic structure body 20 are cooperatively elastically deformed by a larger amount so as to decrease the rotational acceleration of the external impact force and respond to the linear deformation pattern of the shear force as well as together bear the external impact force to provide a cushioning and shock absorption effect. Accordingly, the external impact force is universally (or multidirectionally) distributively transmitted to the filling body 30 and/or the entire assembly 100. Accordingly, the acceleration and rotational torque caused by the external impact force are cushioned, absorbed and decreased. After the external impact force disappears, due to the elastic deformation property of the elastic structure body 20 and/or the filling body 30, the components of the assembly 100 are restored to their home positions (as shown in FIG. 4). For example, the components of the assembly 100 are restored to their home positions as shown by the phantom lines K of FIGS. 6 and 6A.

In comparison with the plastic shell structure of the conventional safety helmet, the main shell body 10 and the subsidiary shell body 50 are both formed with the (elastic) pivotal connection sections 13, 53. This structural form helps in enhancing the connection effect between the main shell body 10 and the subsidiary shell body 50 and the elastic structure body 20. Also, this structural form can increase the structural strength of the main shell body 10 and the subsidiary shell body 50 to bear the external impact force.

It should be noted that the main shell body 10 and the subsidiary shell body 50 are formed with the pivotal connection sections 13, 53 for assembling with the assembling sections 23 of the elastic structure body 20 to form the multilayered floatable structure (or a structural in which the elastic structure body 20 is movably and/or motionally positioned between the main shell body 10 and the subsidiary shell body 50). In this case, the elastic structure body 20 can respond to the aforesaid rotational torque (or shear force) to relatively move between the main shell body 10 and the subsidiary shell body 50 to provide a universal (or multidirectional) rotational displacement and linear displacement (or elastic deformation and linear deformation). Accordingly, the destruction or trauma to the head H caused by the rotational torque can be minimized.

Figure 7:
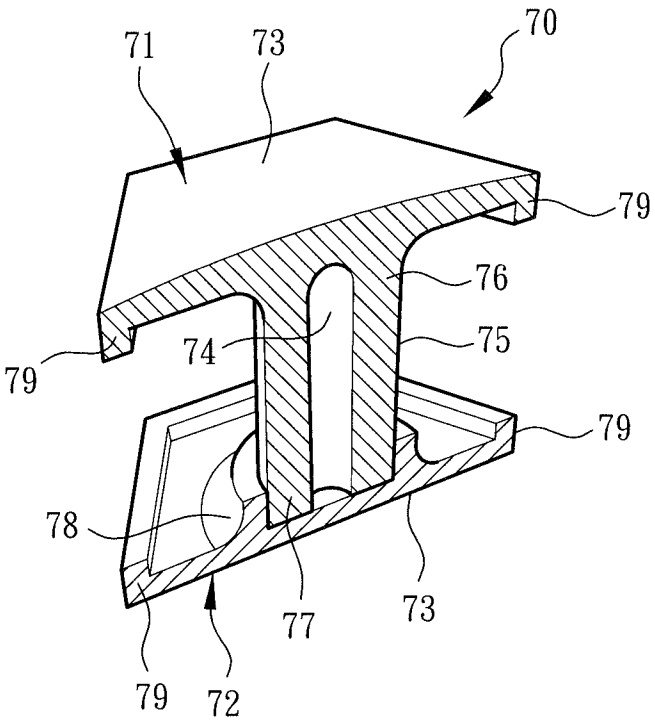
FIG. 7 is a perspective view of the anchor unit of the present invention.
Figure 8:
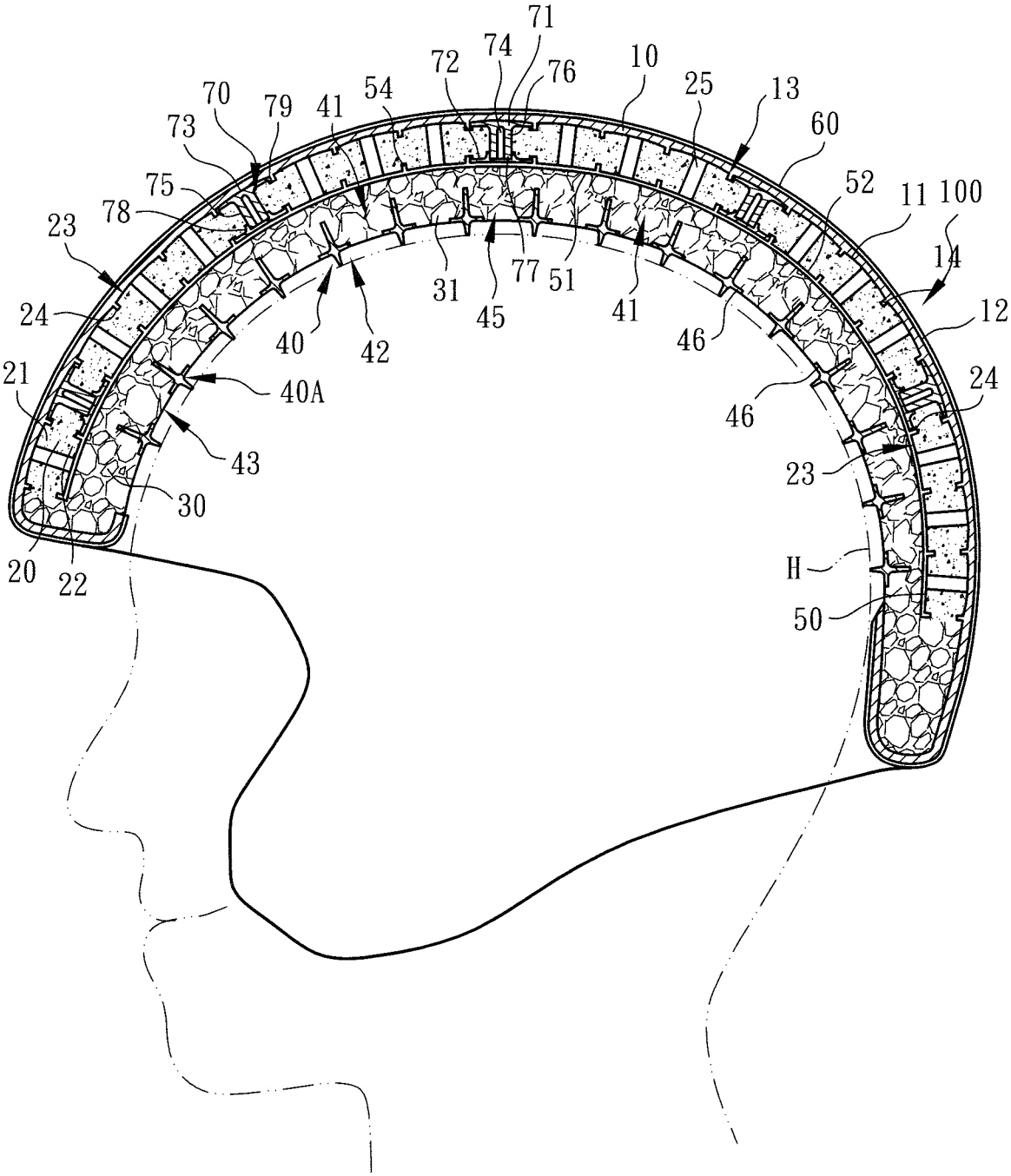
FIG. 8 is a plane sectional view of a modified embodiment of the present invention, showing that the elastic structure body is assembled with the anchor unit.
Figure 9:
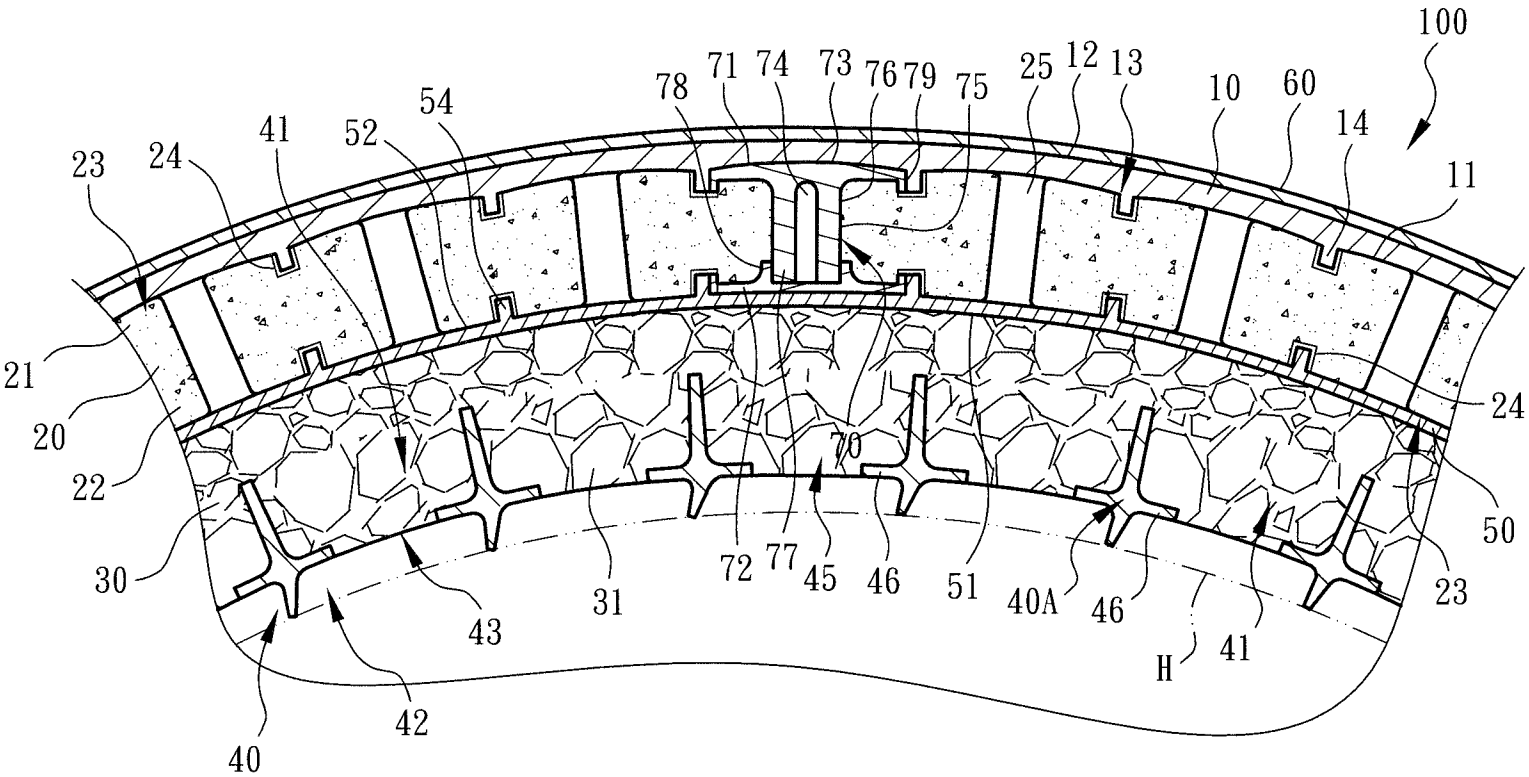
FIG. 9 is an enlarged view of a part of FIG. 8.

Please now refer to FIGS. 7, 8 and 9. In a modified embodiment, the elastic structure body 20 is equipped with an anchor unit 70.

As shown in the drawings, the anchor unit 70 is positioned between the main shell body 10 and the subsidiary shell body 50. In practice, the anchor unit 70 can be disposed on the elastic structure body 20. For example, the anchor unit 70 is arranged on an assembling section 23 or locally between two assembling sections 23 in adjacency to each other, whereby the anchor unit 70 is positioned between the inner face 11 of the main shell body 10 and the outer face 52 of the subsidiary shell body 50. Alternatively, the anchor unit 70 is disposed and assembled in the hole 25 of the elastic structure body 20 to provide an anchoring effect for enhancing the structural strength and securing the assembly.

In this embodiment, the anchor unit 70 is an I-shaped structure. The anchor unit 70 includes a base section 75 and a first arm 71 and a second arm 72 formed on the base section 75. To speak more specifically, an upper section 76 of the base section 75 extends to two sides or the periphery (in a direction normal to the base section 75) to form the first arm 71. The second arm 72 is disposed on a lower section 77 of the base section 75. The second arm 72 extends to two sides or the periphery of the base section 75 (in a direction normal to the base section 75). Each of the first and second arms 71, 72 is formed with a connection face 73 in contact or connection with the inner face 11 (or the pivotal connection section 13) of the main shell body 10 and the outer face 52 (or the pivotal connection section 53) of the subsidiary shell body 50.

It should be noted that the connection faces 73 of the first and second arms 71, 72 can be respectively formed with arched faces according to the radian of the inner face 11 (or the pivotal connection section 13) of the main shell body 10 and the outer face 52 (or the pivotal connection section 53) of the subsidiary shell body 50. Accordingly, the anchor unit 70 can snugly and stably contact or connect with the inner face 11 (or the pivotal connection section 13) of the main shell body 10 and the outer face 52 (or the pivotal connection section 53) of the subsidiary shell body 50. Under such circumstance, when the anchor unit 70 responds to the external impact force, the anchor unit 70 can more smoothly move between the main shell body 10 and the subsidiary shell body 50.

In this embodiment, the second arm 72 is formed with an assembling hole 78 for securely assembling with the lower section 77 of the base section 75. The base section 75 is formed with an internal cavity 74. Therefore, the thickness of the wall of the base section 75 or the (cross-sectional) size of the cavity 74 can be varied to change the deformation amount or elasticity ratio of the anchor unit 70.

Referring to FIGS. 7, 8 and 9, each of two ends of the first and second arms 71, 72 of the anchor unit 70 is formed with a finger section 79. The finger sections 79 are correspondingly assembled with the assembling sections 23 (or grooves 24) of the upper and lower sections 21, 22 of the elastic structure body 20. This establishes a system or an effect to help in supporting the elastic structure body 20.

Figure 10:
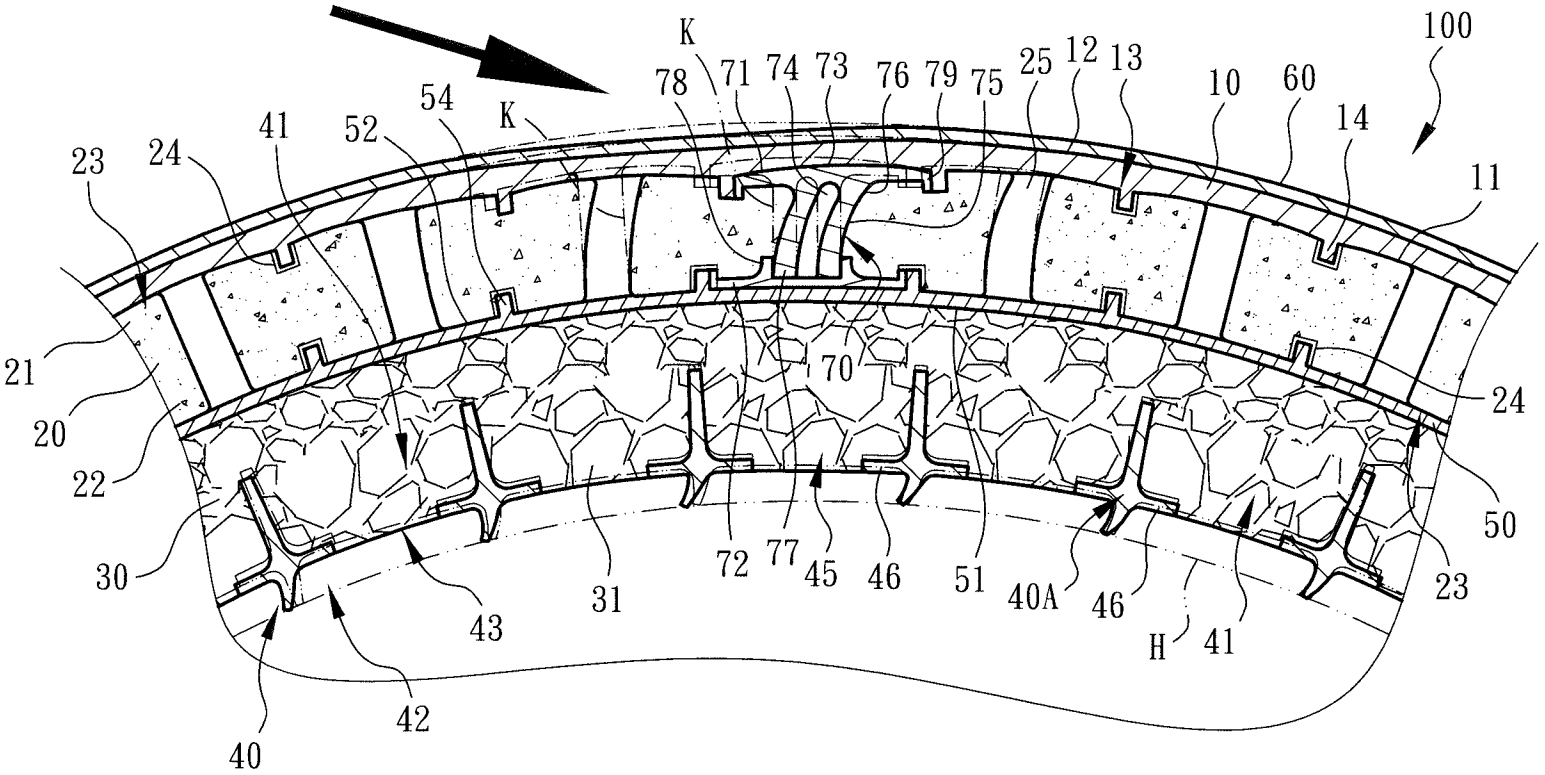
FIG. 10 is a view according to FIG. 9, showing that an external impact force (or shear force) is applied to the assembly, wherein the phantom lines show the home positions of the elastic structure body and the anchor unit.
Figure 10A:
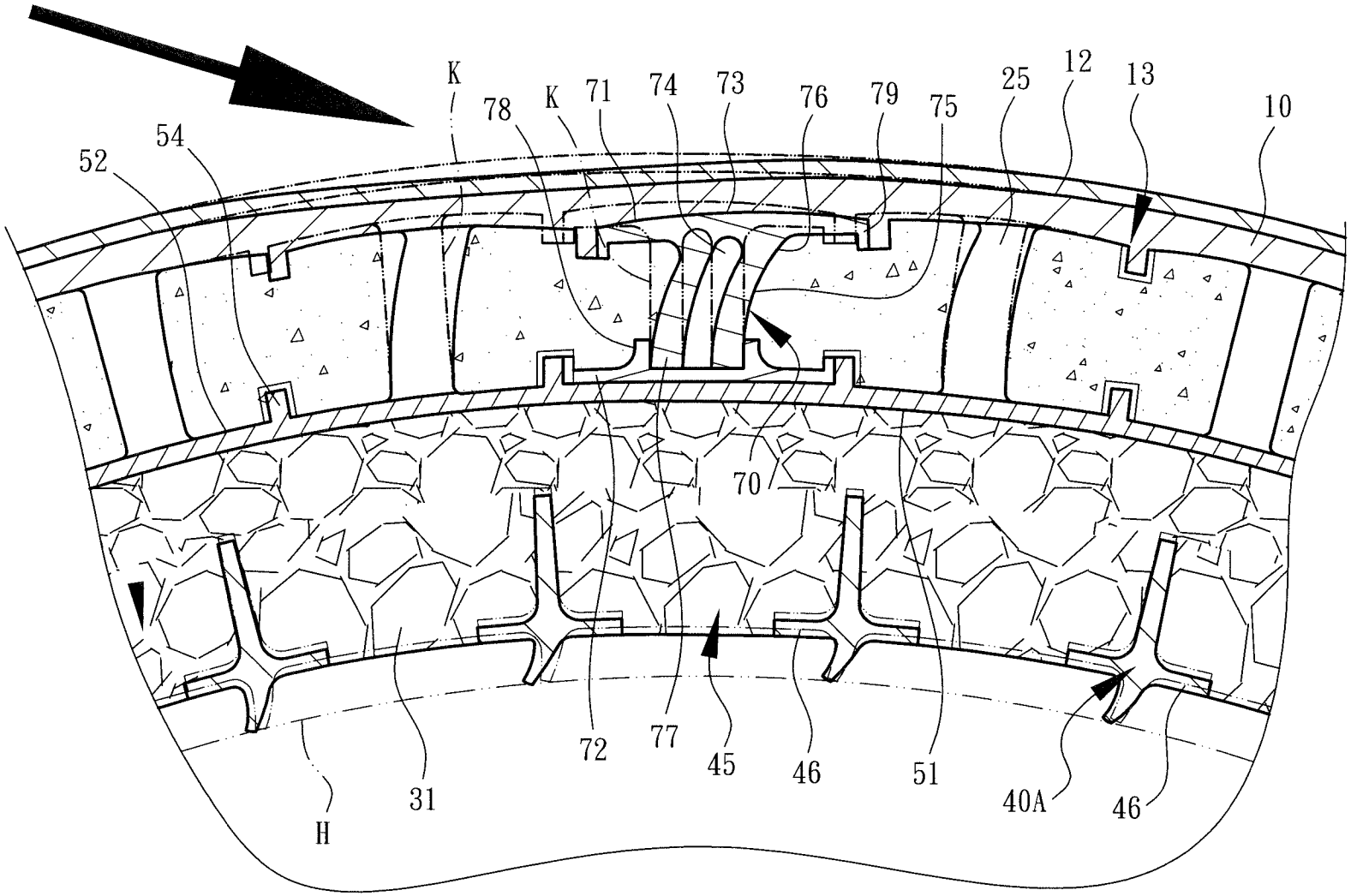
FIG. 10A is an enlarged view of a part of FIG. 10.

Please now refer to FIGS. 10 and 10A. When an external impact force (or shear force) is applied to the assembly 100, the main shell body 10 and/or the subsidiary shell body 50, the filling body 30, the anchor unit 70 and the elastic structure body 20 are cooperatively elastically deformed by a larger amount and respond to the linear deformation pattern of the shear force as well as together bear the external impact force to provide a cushioning and shock absorption effect. Accordingly, the external impact force is universally (or multidirectionally) distributively transmitted to the filling body 30 and/or the entire assembly 100. Accordingly, the acceleration and rotational torque caused by the external impact force are cushioned, absorbed and decreased.

Furthermore, after the external impact force and the rotational torque disappear, the anchor unit 70 further helps the elastic structure body 20 to restore to its home position (as shown in FIGS. 8 and 9). For example, the elastic structure body 20 is restored to its home position as shown by the phantom lines K of FIG. 10.

That is, when bearing the force, the elastic structure body 20 (and/or the anchor unit 70) is permitted to partially relatively slide and/or move between the main shell body 10 and the subsidiary shell body 50. In addition, the elastic structure body 20 can provide larger cushioning tolerance and flexibility to cushion and release the displacement and/or rotational action force between the (assembling) interfaces of the respective components. This can minimize the trauma to a wearer due to the external twisting impact.

It should be noted that multiple or multiple layers of elastic structure bodies 20 can be disposed between the main shell body 10 and the subsidiary shell body 50. Alternatively, the assembly 100 can have a structural form equipped with multiple or multiple layers of subsidiary structure bodies 40.

To speak representatively, in comparison with the conventional safety helmet, the multilayered floatable universal shock absorption system of safety helmet of the present invention has the following advantages:

1. The assembling structures of the main shell body 10, the elastic structure body 20, the subsidiary shell body 50 and the filling body 30 have been redesigned to form the multilayered floatable universal shock absorption system.

For example, the inner face 11 of the main shell body 10 and the outer face 52 of the subsidiary shell body 50 are respectively formed with the protruding walls 14, 54 to define the pivotal connection sections 13, 53. At least one elastic structure body 20 (and/or anchor unit 70) is disposed between the main shell body 10 and the subsidiary shell body 50. The upper and lower sections 21, 22 of the elastic structure body 20 are respectively formed with multiple assembling sections 23 having the grooves 24 for connecting with the pivotal connection sections 13, 53. By means of a mold, the filling body 30 is bonded with the inner face 51 of the subsidiary shell body 50 and the subsidiary structure body 40. The main shell body 10 encloses the elastic structure body 20, the subsidiary shell body 50 and the filling body 30 to form an inter-bonded and reinforced structure. This is obviously different from the structural form of the conventional safety helmet.

2. The main shell body 10 is connected with the elastic structure body 20, the subsidiary shell body 50 and the filling body 30 to form a texture, the structural strength of which is obviously enhanced. In structural form, the manufacturing process of the multilayered floatable universal shock absorption system of safety helmet of the present invention is simplified. Also, the helmet is designed with a lightweight and thinned structural form to provide a more ideal protection and multidirectional cushioning effect. The multilayered floatable universal shock absorption system of safety helmet of the present invention changes the transmission and distribution pattern of the external impact force and improves the shortcoming of the conventional safety helmet. For example, in the conventional safety helmet, the bubble pad is apt to break and lose its cushioning and shock absorption effect. Also, the conventional safety helmet employs filament body or damper structure to increase the structural strength and enhance the cushioning and shock absorption effect. This increases the total volume and weight of the helmet.

3. Especially, the elastic structure body 20, the subsidiary shell body 50, the filling body 30 and/or the anchor unit 70 are bonded with each other to form a texture having a cushioning and shock absorption effect for minimizing the external impact force and speed. Moreover, when these components elastically restore to their home positions, these components further provide a cushioning and shock absorption effect for minimizing the external impact force and speed.

In conclusion, the multilayered floatable universal shock absorption system of safety helmet of the present invention is effective and different from the conventional safety helmet in space form. The multilayered floatable universal shock absorption system of safety helmet of the present invention is inventive, greatly advanced and advantageous over the conventional safety helmet.

The above embodiments are only used to illustrate the present invention, not intended to limit the scope thereof. Many modifications of the above embodiments can be made without departing from the spirit of the present invention.

What is claimed is:

1. A multilayered floatable universal shock absorption system of safety helmet, comprising: a main shell body, an elastic structure body, a subsidiary shell body, and a filling body, assembled with each other, the elastic structure body, the subsidiary shell body, and the filling body being enclosed in the main shell body, each of the main shell body and the subsidiary shell body having an inner face and an outer face, the inner face of the main shell body and the outer face of the subsidiary shell body being respectively formed with multiple pivotal connection sections, the elastic structure body being defined with an upper section and a lower section, the upper and lower sections of the elastic structure body being respectively formed with multiple assembling sections correspondingly assembled with the pivotal connection sections of the main shell body and the subsidiary shell body, the elastic structure body being floatably positioned between the main shell body and the subsidiary shell body, the filling body being bonded with the subsidiary shell body, and the main shell body, the elastic structure body, the subsidiary shell body, and the filling body thereby together form an integrated assembly; and a subsidiary structure body is connected and assembled with a lower section of the filling body, the subsidiary structure body being a cellular structure connected with the filling body, the subsidiary structure body including multiple skeletons, the skeletons defining multiple well-shaped structure sections with a geometrical configuration, protruding wing sections being formed on a periphery of the well-shaped structure sections, each well-shaped structure section being defined with a first section, a second section, and a subsidiary section between the first and second sections.

2. The multilayered floatable universal shock absorption system of safety helmet as claimed in claim 1, wherein the pivotal connection sections of the main shell body and the subsidiary shell body have elasticity, the pivotal connection sections of the main shell body and the subsidiary shell body respectively having protruding walls that define a geometrical configuration of the pivotal connection sections, the upper section of the elastic structure body being connected with the inner face of the main shell body, the lower section of the elastic structure body being connected with the outer face of the subsidiary shell body, the assembling sections of the elastic structure body being formed with grooves, the grooves defining the assembling sections to have a geometrical configuration, the grooves being correspondingly assembled with the protruding walls of the pivotal connection sections of the main shell body and the subsidiary shell body.

3. The multilayered floatable universal shock absorption system of safety helmet as claimed in claim 2, wherein the pivotal connection sections of the main shell body and the subsidiary shell body and the assembling sections of the elastic structure body have a hexagonal configuration, the pivotal connection sections of the main shell body and the subsidiary shell body are respectively adjacent to each other to form a cellular structure and the assembling sections of the elastic structure body are adjacent to each other to form a cellular structure, a protection layer being disposed on the outer face of the main shell body, a hardness of the main shell body and the subsidiary shell body being greater than a hardness of the filling body, an elasticity of the elastic structure body being greater than an elasticity of the filling body, and the elastic structure body having holes formed on the assembling sections and passing through the elastic structure body.

4. The multilayered floatable universal shock absorption system of safety helmet as claimed in claim 1, wherein a portion of a material of the filling body is disposed in the first sections and the subsidiary sections of the subsidiary structure body and connected with the wing sections of the subsidiary structure body, a density of the filling body material in the first sections and the subsidiary sections being lower than a density of the filling body material outside the subsidiary structure body, and a hardness of the elastic structure body being greater than a hardness of the subsidiary structure body.

5. The multilayered floatable universal shock absorption system of safety helmet as claimed in claim 2, wherein a portion of a material of the filling body is disposed in the first sections and the subsidiary sections of the subsidiary structure body and connected with the wing sections of the subsidiary structure body, a density of the filling body material in the first sections and the subsidiary sections being lower than a density of the filling body material outside the subsidiary structure body, and a hardness of the elastic structure body being greater than a hardness of the subsidiary structure body.

6. The multilayered floatable universal shock absorption system of safety helmet as claimed in claim 1, wherein the elastic structure body is equipped with at least one anchor unit, the anchor unit being positioned between the inner face of the main shell body and the outer face of the subsidiary shell body, the anchor unit being an I-shaped structure, the anchor unit including a base section, the base section being defined with an upper section and a lower section, the upper section of the base section being formed with a first arm, the lower section of the base section being formed with a second arm, each of the first and second arms being formed with a connection face in connection with the inner face of the main shell body and the outer face of the subsidiary shell body.

7. The multilayered floatable universal shock absorption system of safety helmet as claimed in claim 2, wherein the elastic structure body is equipped with at least one anchor unit, the anchor unit being positioned between the inner face of the main shell body and the outer face of the subsidiary shell body, the anchor unit being an I-shaped structure, the anchor unit including a base section, the base section being defined with an upper section and a lower section, the upper section of the base section being formed with a first arm, the lower section of the base section being formed with a second arm, each of the first and second arms being formed with a connection face in connection with the inner face of the main shell body and the outer face of the subsidiary shell body.

8. The multilayered floatable universal shock absorption system of safety helmet as claimed in claim 3, wherein the elastic structure body is equipped with at least one anchor unit, the anchor unit being positioned between the inner face of the main shell body and the outer face of the subsidiary shell body, the anchor unit being an I-shaped structure, the anchor unit including a base section, the base section being defined with an upper section and a lower section, the upper section of the base section being formed with a first arm, the lower section of the base section being formed with a second arm, each of the first and second arms being formed with a connection face in connection with the inner face of the main shell body and the outer face of the subsidiary shell body.

9. The multilayered floatable universal shock absorption system of safety helmet as claimed in claim 4, wherein the elastic structure body is equipped with at least one anchor unit, the anchor unit being positioned between the inner face of the main shell body and the outer face of the subsidiary shell body, the anchor unit being an I-shaped structure, the anchor unit including a base section, the base section being defined with an upper section and a lower section, the upper section of the base section being formed with a first arm, the lower section of the base section being formed with a second arm, each of the first and second arms being formed with a connection face in connection with the inner face of the main shell body and the outer face of the subsidiary shell body.

10. The multilayered floatable universal shock absorption system of safety helmet as claimed in claim 5, wherein the elastic structure body is equipped with at least one anchor unit, the anchor unit being positioned between the inner face of the main shell body and the outer face of the subsidiary shell body, the anchor unit being an I-shaped structure, the anchor unit including a base section, the base section being defined with an upper section and a lower section, the upper section of the base section being formed with a first arm, the lower section of the base section being formed with a second arm, each of the first and second arms being formed with a connection face in connection with the inner face of the main shell body and the outer face of the subsidiary shell body.

11. The multilayered floatable universal shock absorption system of safety helmet as claimed in claim 6, wherein the anchor unit is positioned between the assembling sections in adjacency to each other, the upper section of the base section extending to two sides of the base section in a direction normal to the base section to form the first arm, the second arm extending to two sides of the base section in a direction normal to the base section, the second aim being formed with an assembling hole for securely assembling with the lower section of the base section, the base section being formed with an internal cavity, the connection faces of the first and second arms being respectively formed with arched faces according to a radian of the inner face of the main shell body and the outer face of the subsidiary shell body, the connection faces of the anchor unit connecting with the inner face of the main shell body and the outer face of the subsidiary shell body, each of two ends of the first and second arms of the anchor unit being formed with a finger section, the finger sections being correspondingly assembled with the assembling sections of the upper and lower sections of the elastic structure body.

12. The multilayered floatable universal shock absorption system of safety helmet as claimed in claim 7, wherein the anchor unit is positioned between the assembling sections in adjacency to each other, the upper section of the base section extending to two sides of the base section in a direction normal to the base section to form the first arm, the second arm extending to two sides of the base section in a direction normal to the base section, the second aim being formed with an assembling hole for securely assembling with the lower section of the base section, the base section being formed with an internal cavity, the connection faces of the first and second arms being respectively formed with arched faces according to a radian of the inner face of the main shell body and the outer face of the subsidiary shell body, the connection faces of the anchor unit connecting with the inner face of the main shell body and the outer face of the subsidiary shell body, each of two ends of the first and second arms of the anchor unit being formed with a finger section, the finger sections being correspondingly assembled with the assembling sections of the upper and lower sections of the elastic structure body.

13. The multilayered floatable universal shock absorption system of safety helmet as claimed in claim 8, wherein the anchor unit is positioned between the assembling sections in adjacency to each other, the upper section of the base section extending to two sides of the base section in a direction normal to the base section to form the first arm, the second arm extending to two sides of the base section in a direction normal to the base section, the second aim being formed with an assembling hole for securely assembling with the lower section of the base section, the base section being formed with an internal cavity, the connection faces of the first and second arms being respectively formed with arched faces according to a radian of the inner face of the main shell body and the outer face of the subsidiary shell body, the connection faces of the anchor unit connecting with the inner face of the main shell body and the outer face of the subsidiary shell body, each of two ends of the first and second arms of the anchor unit being formed with a finger section, the finger sections being correspondingly assembled with the assembling sections of the upper and lower sections of the elastic structure body.

14. The multilayered floatable universal shock absorption system of safety helmet as claimed in claim 9, wherein the anchor unit is positioned between the assembling sections in adjacency to each other, the upper section of the base section extending to two sides of the base section in a direction normal to the base section to form the first arm, the second arm extending to two sides of the base section in a direction normal to the base section, the second aim being formed with an assembling hole for securely assembling with the lower section of the base section, the base section being formed with an internal cavity, the connection faces of the first and second arms being respectively formed with arched faces according to a radian of the inner face of the main shell body and the outer face of the subsidiary shell body, the connection faces of the anchor unit connecting with the inner face of the main shell body and the outer face of the subsidiary shell body, each of two ends of the first and second arms of the anchor unit being formed with a finger section, the finger sections being correspondingly assembled with the assembling sections of the upper and lower sections of the elastic structure body.

15. The multilayered floatable universal shock absorption system of safety helmet as claimed in claim 10, wherein the anchor unit is positioned between the assembling sections in adjacency to each other, the upper section of the base section extending to two sides of the base section in a direction normal to the base section to form the first arm, the second arm extending to two sides of the base section in a direction normal to the base section, the second aim being formed with an assembling hole for securely assembling with the lower section of the base section, the base section being formed with an internal cavity, the connection faces of the first and second arms being respectively formed with arched faces according to a radian of the inner face of the main shell body and the outer face of the subsidiary shell body, the connection faces of the anchor unit connecting with the inner face of the main shell body and the outer face of the subsidiary shell body, each of two ends of the first and second arms of the anchor unit being formed with a finger section, the finger sections being correspondingly assembled with the assembling sections of the upper and lower sections of the elastic structure body.

16. The multilayered floatable universal shock absorption system of safety helmet as claimed in claim 1, wherein gaps exist between the elastic structure body, the main shell body, and the subsidiary shell body.

17. The multilayered floatable universal shock absorption system of safety helmet as claimed in claim 2, wherein gaps exist between the elastic structure body, the main shell body, and the subsidiary shell body.

18. The multilayered floatable universal shock absorption system of safety helmet as claimed in claim 6, wherein gaps exist between the elastic structure body, the main shell body, and the subsidiary shell body.

19. The multilayered floatable universal shock absorption system of safety helmet as claimed in claim 11, wherein gaps exist between the elastic structure body, the main shell body, and the subsidiary shell body.

* * * * *